US009877594B2

(12) United States Patent
Babikian

(10) Patent No.: US 9,877,594 B2
(45) Date of Patent: Jan. 30, 2018

(54) SEAT

(71) Applicant: BOBRICK WASHROOM EQUIPMENT, INC., North Hollywood, CA (US)

(72) Inventor: Dikran Babikian, Glendale, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 20 days.

(21) Appl. No.: 14/630,271

(22) Filed: Feb. 24, 2015

(65) Prior Publication Data

US 2015/0238025 A1 Aug. 27, 2015

Related U.S. Application Data

(60) Provisional application No. 61/943,968, filed on Feb. 24, 2014.

(51) Int. Cl.

| | |
|---|---|
| ***A47D 1/10*** | (2006.01) |
| ***A47C 1/12*** | (2006.01) |
| ***A47C 7/02*** | (2006.01) |

(52) U.S. Cl.

CPC ..... *A47D 1/103* (2013.01); *A47C 1/12* (2013.01); *A47C 7/021* (2013.01)

(58) Field of Classification Search

CPC ..... B60N 2/2821; B60N 2/286; A47D 1/103; A47C 1/12

USPC ..... 297/256.16, 250.1; 248/188.8, 188.9

See application file for complete search history.

(56) References Cited

U.S. PATENT DOCUMENTS

| | | | | |
|---|---|---|---|---|
| D178,352 | S * | 7/1956 | Free | 297/467 |
| 4,950,033 | A | 8/1990 | Anderson | |
| 5,318,339 | A * | 6/1994 | Cherniak | B60N 2/245 297/242 |
| 5,634,223 | A | 6/1997 | Obermaier | |
| 5,779,306 | A * | 7/1998 | Ohlsson | A47K 13/06 297/182 |
| D431,943 | S * | 10/2000 | Lee | D6/716.1 |

(Continued)

FOREIGN PATENT DOCUMENTS

| | | |
|---|---|---|
| DE | 9 416 126 U1 | 2/1995 |
| WO | WO 2014/018916 A1 | 1/2014 |

OTHER PUBLICATIONS

PCT Search Report and Written Opinion dated Feb. 24, 2015 for Application PCT/US2015/017328; 11 Pages.

(Continued)

*Primary Examiner* — David R Dunn

(74) *Attorney, Agent, or Firm* — Lewis Roca Rothgerber Christie LLP

(57) ABSTRACT

A seat is includes a seating surface, a peripheral surface extending transversely from the seating surface, a base surface extending from the peripheral surface, and a plurality of protrusions extending from the base surface. A seat and supporting surface combination includes a supporting surface, a seat resting on the supporting surface and including, a seating surface, a peripheral surface extending transversely from the seating surface, a base surface extending from the peripheral surface, and a plurality of protrusions extending from the base surface and engaging the supporting surface.

25 Claims, 6 Drawing Sheets

(56) References Cited

U.S. PATENT DOCUMENTS 6,324,725 B1 * 12/2001 Green ..... A47B 91/06 16/42 R
6,811,125 B1 * 11/2004 Koefelda ..... F16M 5/00 108/53.1
6,997,509 B2 * 2/2006 Kain ..... B60N 2/2866 297/188.01
7,452,034 B2 * 11/2008 Jung ..... A47C 7/004 248/188.7
7,837,160 B2 * 11/2010 Huang ..... G06F 1/1616 248/188.2
8,382,202 B2 * 2/2013 Gillett ..... B60N 2/2866 297/188.14
8,678,499 B2 * 3/2014 Kelly ..... B60N 2/2866 297/219.12
8,764,109 B2 * 7/2014 Kummerfeld ..... A47D 1/008 297/174 CS
9,033,420 B2 * 5/2015 Lievestro ..... A47C 27/15 297/452.48
2003/0067198 A1 * 4/2003 Treen ..... A47D 1/002 297/250.1
2004/0239166 A1 * 12/2004 Kihlberg ..... B60N 2/2812 297/250.1
2004/0245820 A1 * 12/2004 Sorrenti ..... A47C 3/16 297/230.1
2008/0042025 A1 * 2/2008 Brouard ..... A47B 91/06 248/188.9
2010/0084901 A1 * 4/2010 Flannery ..... A47D 1/103 297/250.1
2011/0241388 A1 * 10/2011 Kemp ..... A47C 7/021 297/183.1
2011/0304180 A1 * 12/2011 Dasent ..... B60N 2/2806 297/250.1
2012/0068507 A1 3/2012 Debevec et al.
2013/0276845 A1 * 10/2013 Moulton ..... A45B 9/04 135/72
2014/0225405 A1 * 8/2014 Mella ..... A47C 4/54 297/256.16
2014/0252825 A1 * 9/2014 Amirault ..... B60N 2/2866 297/250.1
2015/0238018 A1 * 8/2015 Backer ..... A47C 7/46 5/640

OTHER PUBLICATIONS

International Preliminary Report on Patentability and Written Opinion issued in PCT/US2015/017328, Sep. 9, 2016, 8 pages.

* cited by examiner

SEAT

CROSS REFERENCE TO RELATED APPLICATION

This application is based upon and claims priority on U.S. Provisional Application No. 61/943,968 filed on Feb. 24, 2014, the contents of which are fully incorporated herein by reference.

BACKGROUND

Seats, such as booster seats used over chairs, as for example in movie theaters to support children, include a raised seating surface and legs extending from the seating surface. A Velcro type material typically adheres at the base of the legs, such that when the child seat is placed on top of the seating surface, the Velcro type material engages the fabric surface of the seat and grips onto it. The problem with these types of seats is that the Velcro at many times delaminates or disconnects from the base of the child seat. Furthermore, when the seat is pulled off, the Velcro type material tends to damage the fabric of the seat as it pulls fibers out from the seat or otherwise scrapes the fibers of the seat creating fuzz on the seat fabric and often weaken the fabric leading to holes forming on the fabric.

SUMMARY OF THE INVENTION

In an example embodiment, a seat, such as a child seat, is provided including a seating surface, a peripheral surface extending transversely from the seating surface, a base surface extending from the peripheral surface, and a plurality of protrusions extending from the base surface. In another example embodiment, the base surface extends transversely for the entire peripheral surface. In a further example embodiment, the base surface is an annular surface. In yet another example embodiment, the base includes a first side opposite and second side, a third side extending between the first and second sides, a fourth side opposite the third side and extending between the first and second sides. In a further example embodiment, the plurality of protrusions extend only from the first and second sides. In yet a further example embodiment, the protrusion are blunt protrusions. In one example embodiment, the protrusion are elongated protrusions elongated along the base, and each of the plurality of protrusions has a length along the base, a width transverse to the base and a height extending from the base, such that the length is greater than the width and greater than the height. In another example embodiment, the height is in the range of 1 to 5 mm, the width is in the range of 2 to 7 mm, and wherein length is in the range of 3 to 15 mm, wherein the length is greater than the width which is greater than the height. In yet another example embodiment, each of the plurality of protrusions is hemi-spherical. In a further example embodiment, each of the plurality of protrusions has a height extending from the base such that each protrusion has at least one dimension transverse to its height in the range of 2 to 10 mm In yet a further example embodiment, the base surface is made from a first material and the protrusions are made from a second material different than the first material.

In a further example embodiment, a seat, such as a child seat, and supporting surface combination is provided including a supporting surface, a seat resting on the supporting surface and including, a seating surface, a peripheral surface extending transversely from the seating surface, a base surface extending from the peripheral surface, and a plurality of protrusions extending from the base surface and engaging the supporting surface. In yet another example embodiment, the supporting surface is a fabric surface. In another example embodiment, the supporting surface is a leather surface. In yet another example embodiment, the supporting surface is a plastic surface. In one example embodiment, the supporting surface is a surface of a seat. In another example embodiment, the supporting surface is a surface of a cinema seat. In yet another example embodiment, the base surface extends transversely for the entire peripheral surface. In a further example embodiment, the base surface is an annular surface. In a further example embodiment, the base surface is an annular surface. In yet another example embodiment, the base includes a first side opposite and second side, a third side extending between the first and second sides, a fourth side opposite the third side and extending between the first and second sides. In a further example embodiment, the plurality of protrusions extend only from the first and second sides. In yet a further example embodiment, the protrusion are blunt protrusions. In one example embodiment, the protrusion are elongated protrusions elongated along the base, and each of the plurality of protrusions has a length along the base, a width transverse to the base and a height extending from the base, such that the length is greater than the width and greater than the height. In another example embodiment, the height is in the range of 1 to 5 mm, the width is in the range of 2 to 7 mm, and wherein length is in the range of 3 to 15 mm, wherein the length is greater than the width which is greater than the height. In yet another example embodiment, each of the plurality of protrusions is hemi-spherical. In a further example embodiment, each of the plurality of protrusions has a height extending from the base such that each protrusion has at least one dimension transverse to its height in the range of 2 to 10 mm In yet a further example embodiment, the base surface is made from a first material and the protrusions are made from a second material different than the first material.

DETAILED DESCRIPTION

Figure 1:
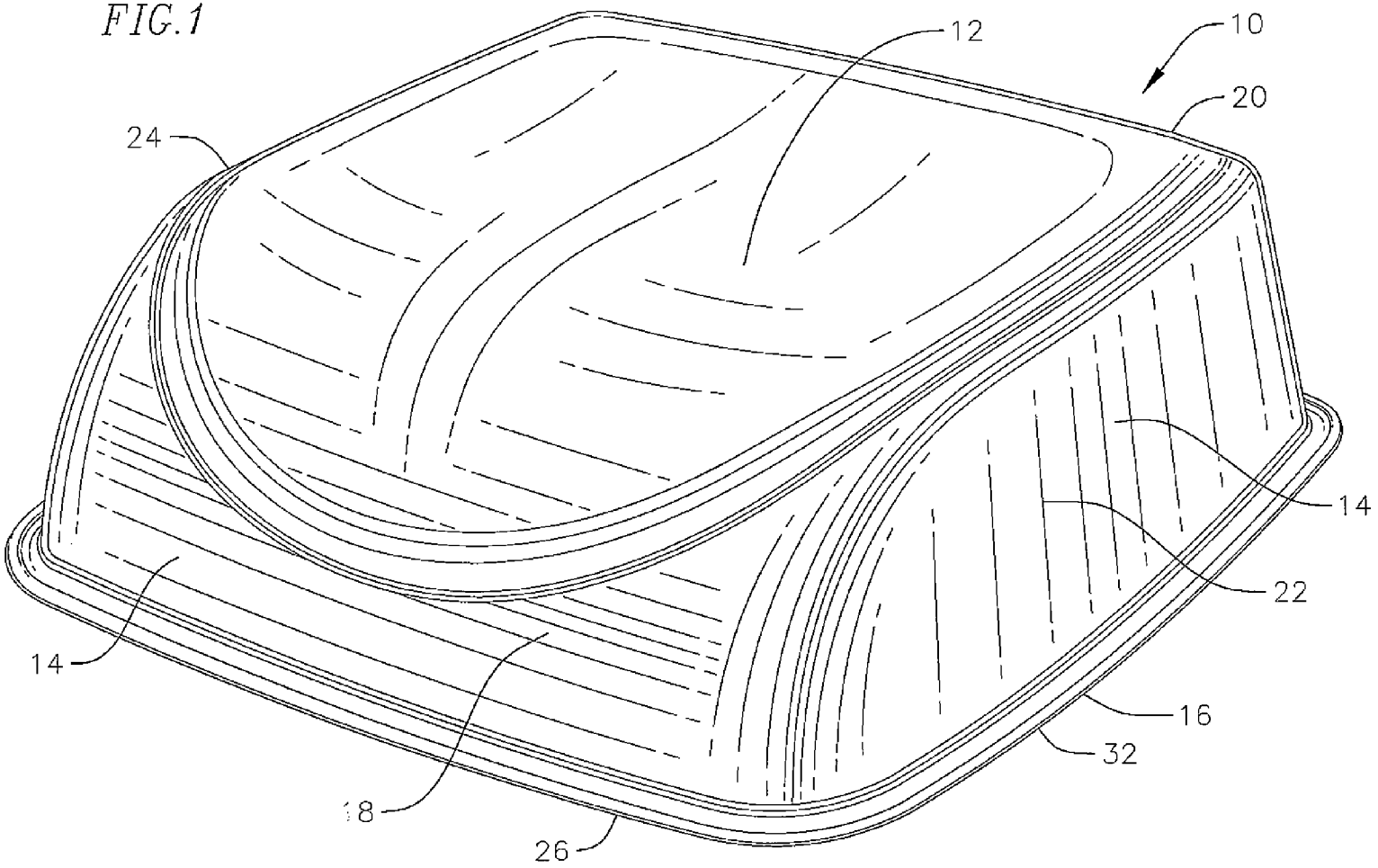
FIG. 1 is a perspective view of an example embodiment seat.

In an example embodiment, a seat, such as a child seat, 10 of the present disclosure has a unitary structure which includes a seating surface 12 and a peripheral surface 14 extending transversely from the seating surface, as for example shown in FIG. 1. Example embodiments are described herein in reference to a child seat for illustrative purposes only. In one example embodiment the seat is a child seat. In other example embodiments, the seat may be a seat for adults. A base 16 is defined at the bottom of the peripheral surface of the seat, as for example shown in FIGS.

1 and 2. The peripheral surface in an example embodiment defines a front surface 18 opposite a rear surface 20 and two opposite side surfaces 22, 24 extending between the front surface 18 and rear surface 20. In an example embodiment, the seat is molded, as for example by injection molding, rotational molding or other molding process from a single material. Example materials that may be used to form the seat include but are not limited to polyethylene, polypropylene, ABC and combinations thereof. The base 16 extends transversely or radially outward from the peripheral surface as for example shown in FIGS. 1 and 2. In other example embodiments, the base may extend radially inward from the peripheral surface. In other example embodiments, the base may extend along the entire peripheral surface. In such an embodiment, the base has a front portion 26 extending from the front surface 18, a rear portion 28 extending from the rear surface 20, and two opposite side portions 30, 32, extending from the opposite side surfaces 20 and 22, respectively, as for example shown in FIG. 2. In other example embodiments, the base may extend along a portion or portions of the peripheral surface. For example, it may extend only along opposite surfaces of the peripheral surface, i.e., may extend only from the front and rear surfaces or from the two opposite side surfaces. In other words the base may only have a front and a rear portion or two side portions, or any two portions or any portion thereof.

Figure 2:
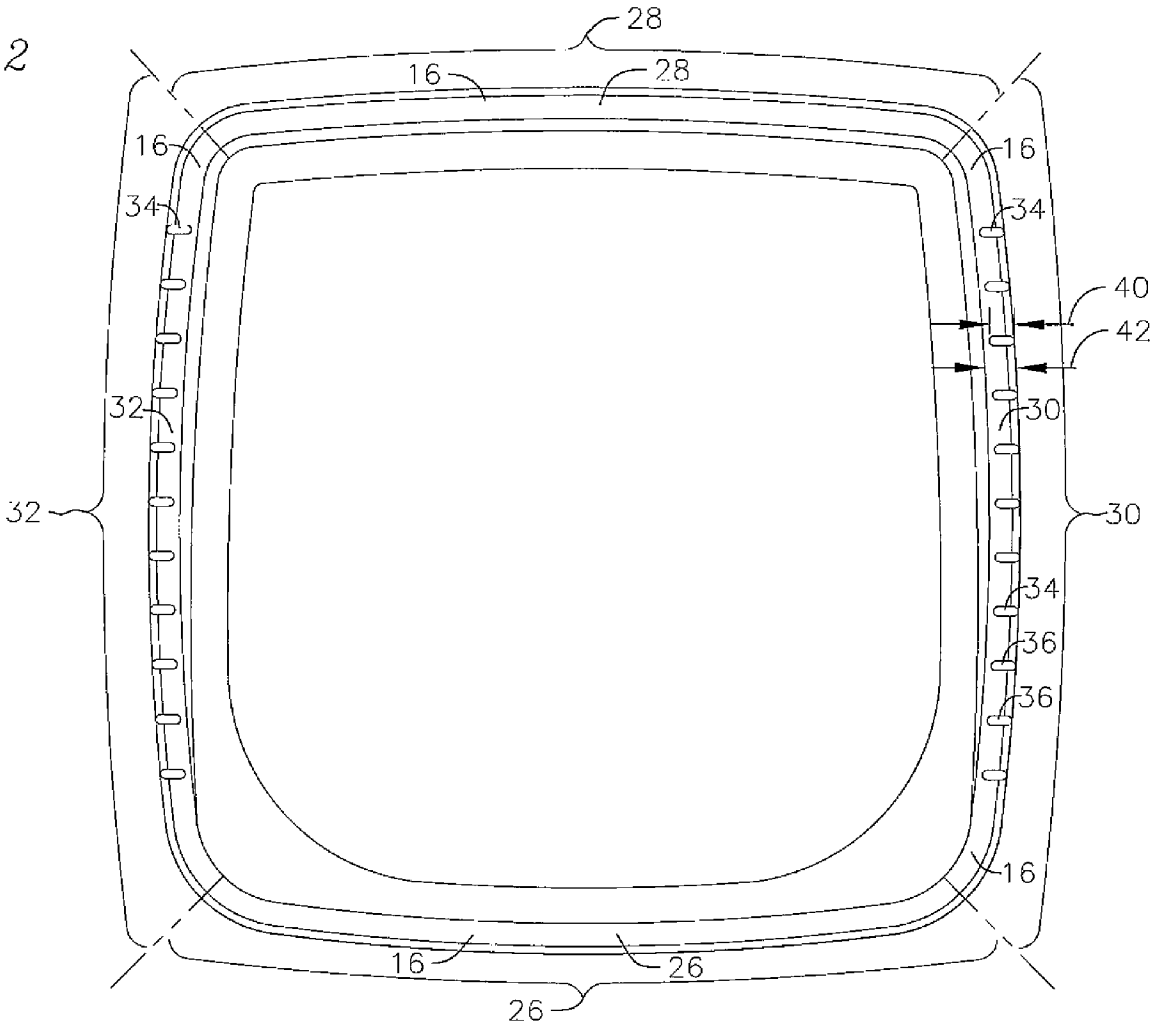
FIG. 2 is a bottom view of the example embodiment seat shown in FIG. 1.
Figure 3:
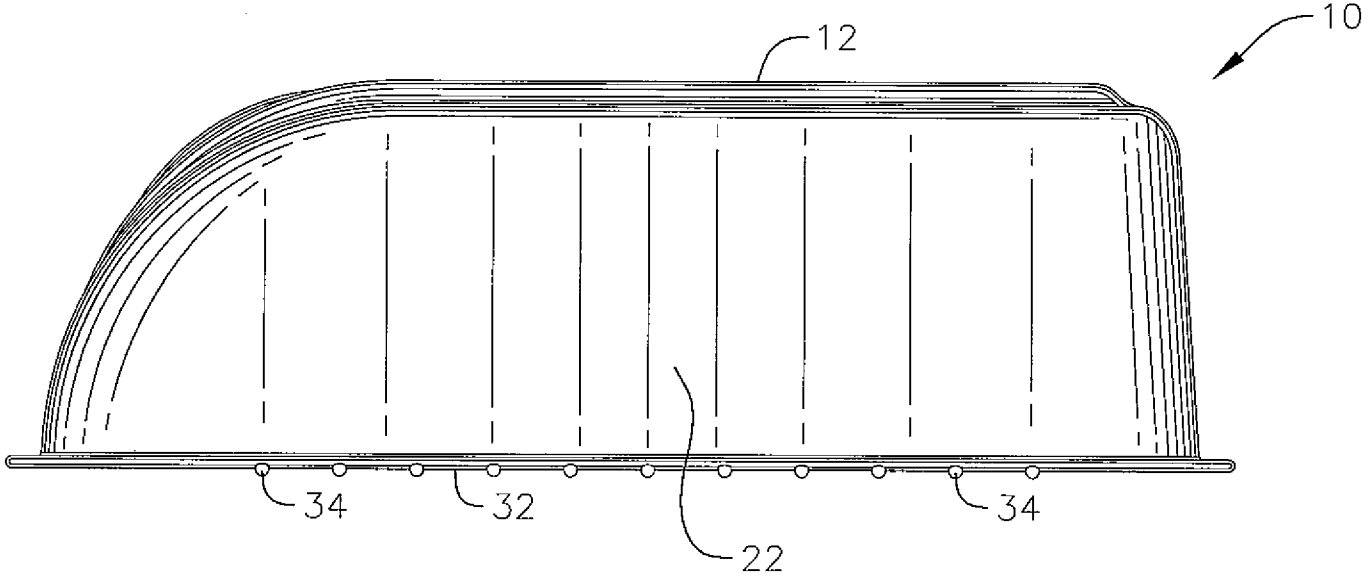
FIG. 3 is a side view of the example embodiment seat shown in FIG. 1.
Figure 4:
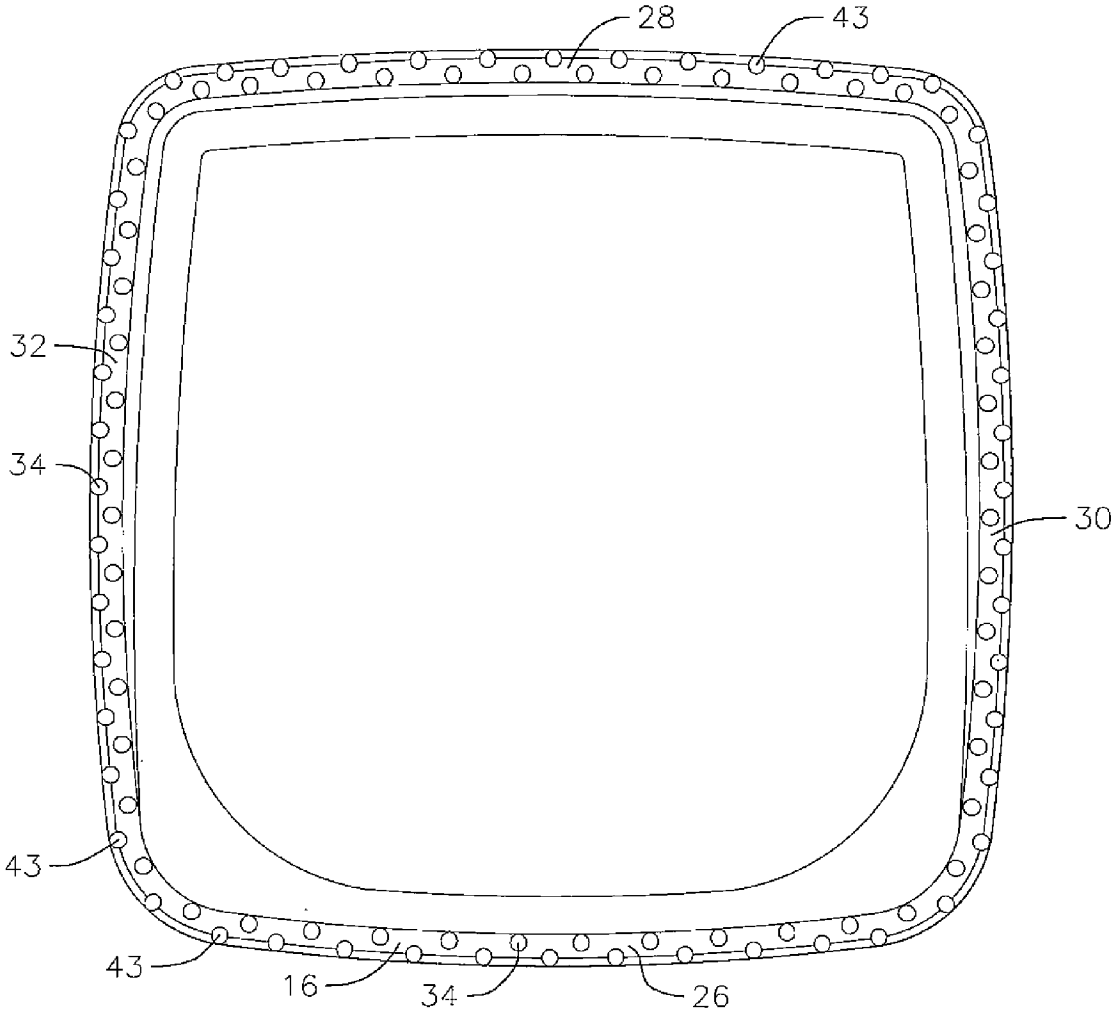
FIG. 4 is a bottom view of another example embodiment seat.

Protrusions 34 extend from the base 16, as for example shown in FIGS. 2, 3 and 4. In an example embodiment, protrusions extend only from the base side portions 30, 32, as for example shown in FIG. 2. In an example embodiment each protrusion defines a blunt, non-sharp, surface. In an example embodiment, as shown in FIGS. 2 and 3, the protrusions are elongated rib-like protrusions 36 extending below the base and from the base and which are spaced apart from each other. These protrusions may be parallel to each other. They also may be staggered relative to each other. As shown in FIG. 2, in an example embodiment these rib-like protrusions have a length 40 that may run along a width 42 of the base portion. In this regard, when the seat is placed with its base on a surface, the rib-like protrusions provide more friction against such surface in a direction transverse to the width 42. In an example embodiment, the protrusions run along a portion of the width of each base portion on which they are formed or along the entire width of each base portion on which they are formed. In another example embodiment the protrusions may extend from all of the base portions, i.e., the front and rear portions as well as the side portions, as for example shown in FIG. 4. In another example embodiment, the protrusions span only a portion of at least one of the base portions.

Figure 6:
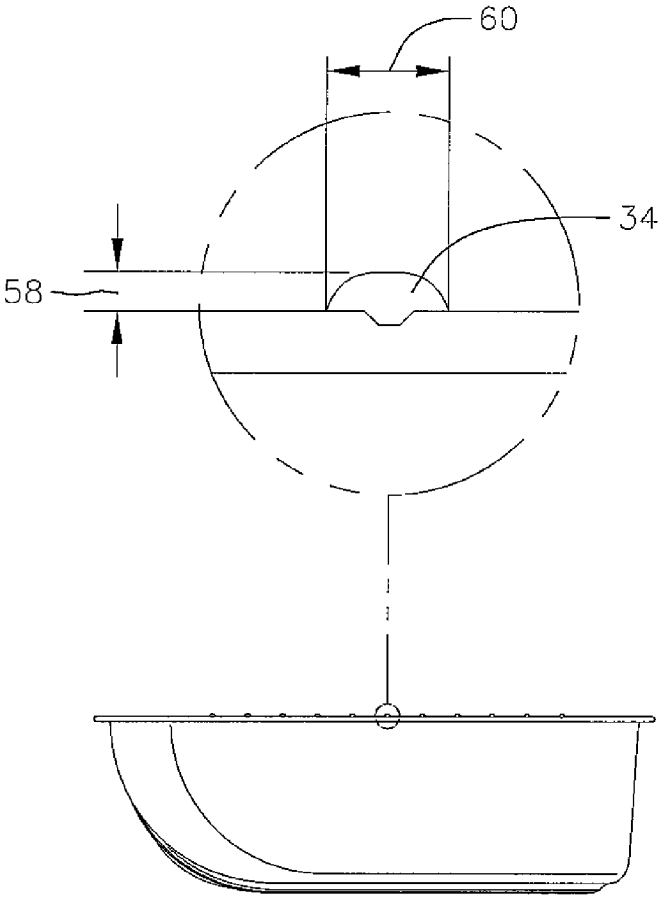
FIG. 6 is a partial exploded view of another example embodiment seat.

In another example embodiment, instead of rib-like protrusions, hemispherical protrusions 43 may extend from the base portion(s), as for example shown in FIG. 4. The protrusions may be spaced apart and may be staggered. Some protrusions 34 may be round having a flatter upper surface, as for example shown in FIG. 6. In an example embodiment, such protrusions having a height 58 of about 2.8 mm and a diameter 60 of about 3.8 mm.

In an example embodiment, the protrusions and the base are formed from the same material. In another example embodiment, the protrusions may be formed from a different material than at least a major portion of the child seat. In a further example embodiment, the protrusions are formed from a different material than the entire seat. In yet further example embodiments, the protrusions and/or at least a portion of the seat is made from a first material while the rest of the seat is made from a second different material or other different materials. The seat in an example embodiment is however formed as a unitary structure in that the seat and protrusions are all formed during the same process, as for example during the same molding process. In the shown example embodiment, the seat is one continuous surface. In this regard, it is easy to manufacture. In an example embodiment, when the child seat is placed on a regular seat, as for example a cinema seat, the protrusions press against the fabric when the child sits on the child seat, creating sufficient friction preventing the child seat from sliding relative to the seat. In addition, the blunt protrusions do not damage the fabric, unlike Velcro. Moreover, because the protrusions are integrally formed with a child seat, they do not delaminate from the child seat.

Figure 5B:
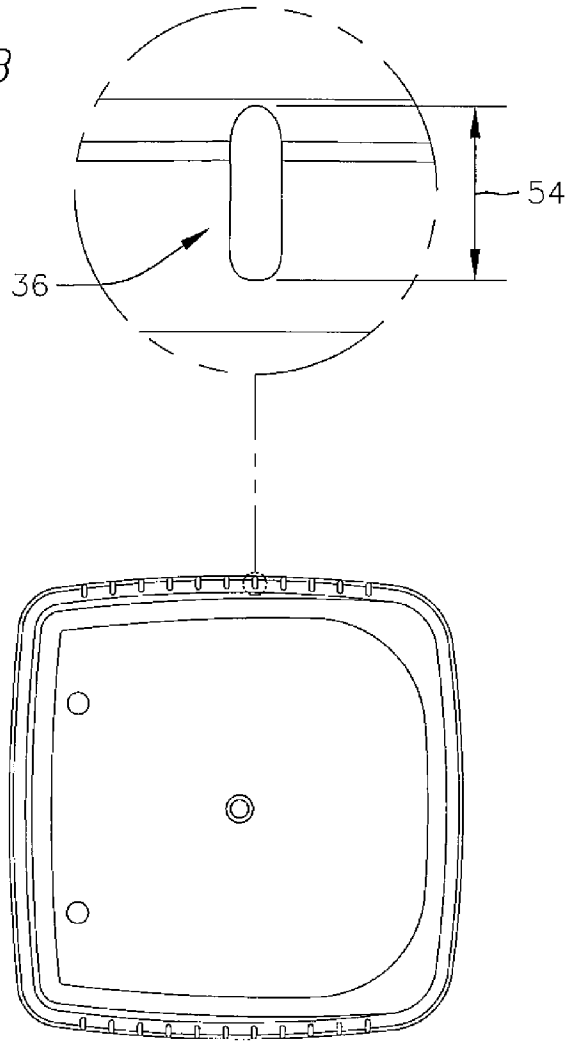
FIGS. 5A and 5B depict partial exploded views of FIGS. 2 and 3, respectively.
Figure 5A:
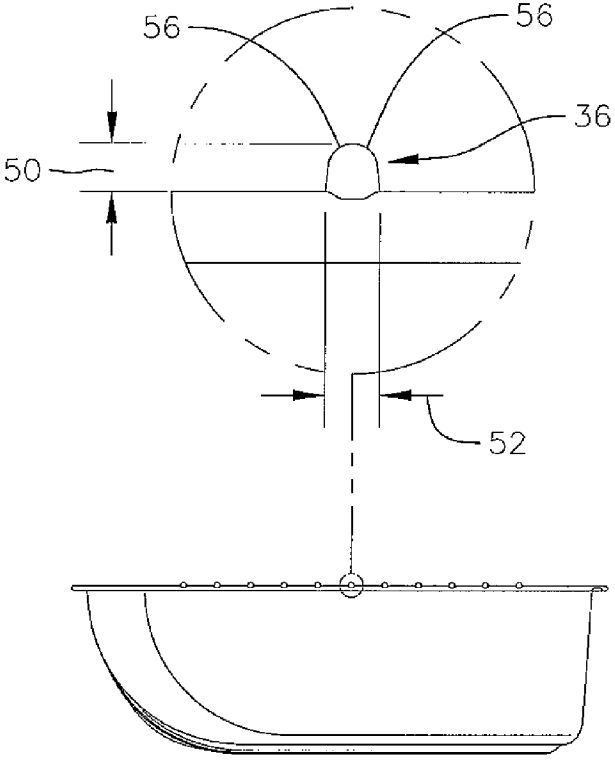

To provide for sufficient grip with the seat that the child rest rests upon in an example embodiment each protrusion has a height 50 in the range of 1 to 5 mm, a width 52 in the range of 2 to 7 mm and a length 54 of 3 to 15 mm (FIGS. 5A and 5B). In other example embodiments, each protrusion has a height in the range of 2 to 4 mm, a width in the range of 2 to 5 mm, and a length of 5 to 10 mm. In one example embodiment, the height 50 is about 2.8 mm, the width 52 is about 3.8 mm and the length 54 about 12.3 mm. The upper surface has two opposite rounded edges 56, each having a radius of about 1.6 mm. In other example embodiments, each protrusion has at least a dimension transverse to its height (e.g., length, width or diameter) in the range of 2 to 10 mm, preferably in the range of 2 to 5 mm, and more preferably in the range of 3 to 5 mm. Moreover, unlike Velcro, the protrusions allow for the child seat to be used on leather, plastic and other material surface seats or chairs, as the protrusions of the present disclosure will not damage such materials in such seats or chairs.

In other example embodiments, instead of the base being annular, the base extends along an entire bottom of the child seat. For example, the base extends the entire distance between the two side surfaces 22, 24 and between the first surface 18 and the rear surface 20.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention.

What is claimed is:

1. A seat comprising:

a seating surface;

a peripheral surface extending transversely from the seating surface;

a base surface extending along a direction transversely from the peripheral surface, said base surface bounding an opening defining a periphery around said opening, said base surface having a length along the periphery of said opening and a width transverse to the length wherein the width is along said direction, and wherein the length is longer than the width; and a plurality of blunt protrusions extending from the base surface, wherein the plurality of protrusions are elongated protrusions elongated along the direction, wherein each of said plurality of protrusions has a length along the direction, a width transverse to the direction and a height extending from the base and transverse to the length and width, wherein the height is in the range of 1 to 5 mm, the width is in the range of 2 to 7 mm, and wherein length is in the range of 3 to 15 mm, wherein the length is greater than the width, and the width is greater than the height, wherein said protrusions provide sufficient friction to prevent or reduce sliding movement of said seat relative to a supporting surface comprising at least one of a fabric, leather or plastic, when said seat is placed on said supporting surface and a human is seated on said seat.

2. The seat of claim 1, wherein the base surface comprises a first portion opposite and spaced apart from a second portion, a third portion extending between the first and second portions, a fourth portion opposite the third portion and extending between the first and second portions, wherein the fourth portion is spaced apart from the third portion.

3. The seat of claim 2, wherein the plurality of protrusions extend only from the first and second portions, and wherein a plurality of protrusions extend from the first portion and another plurality of said plurality of protrusions extend from the second portion.

4. The seat of claim 2, wherein a plurality of protrusions extends from each of the first, second, third and fourth portions.

5. The seat of claim 1, wherein the base surface is made from a first material and the protrusions are made from a second material different than the first material.

6. A seat and supporting surface combination comprising:

a supporting surface;

a seat resting on the supporting surface and comprising, a seating surface, a peripheral surface extending transversely from the seating surface, a base surface extending along a direction transversely from the peripheral surface, said base surface bounding an opening defining a periphery around said opening, said base surface having a length along the periphery of said opening and a width transverse to the length wherein the width is along said direction, and wherein the length is longer than the width, and a plurality of blunt protrusions extending from the base surface and engaging the supporting surface, wherein the plurality of protrusions are elongated protrusions elongated along the direction, wherein each of said plurality of protrusions has a length along the direction, a width transverse to the direction and a height extending from the base and transverse to the length and width, wherein the length is greater than the width and greater than the height, wherein the height is in the range of 1 to 5 mm, the width is in the range of 2 to 7 mm, and wherein length is in the range of 3 to 15 mm, wherein the length is greater than the width, and the width is greater than the height, wherein said protrusions provide sufficient friction to prevent or reduce sliding movement of said seat relative to said supporting surface when a human is seated on said seat, wherein said supporting surface comprises at least one of a fabric, leather or plastic.

7. The combination of claim 6, wherein the supporting surface is a surface of a seat.

8. The combination of claim 6, wherein the base surface comprises a first portion opposite and spaced apart from a second portion, a third portion extending between the first and second portions, a fourth portion opposite the third portion and extending between the first and second portions, wherein the fourth portion is spaced apart from the third portion.

9. The combination of claim 8, wherein the plurality of protrusions extend only from the first and second portions, and wherein a plurality of said plurality of protrusions extend from the first portion and another plurality of said plurality of protrusions extend from the second portion.

10. The combination of claim 8, wherein a plurality of protrusions extends from each of the first, second, third and fourth portions.

11. The combination of claim 6, wherein the base surface is made from a first material and the plurality of protrusions are made from a second material different than the first material.

12. A seat comprising:

a seating surface;

a peripheral surface extending transversely from the seating surface;

a base surface extending from the peripheral surface, said base surface bounding an opening, said base surface having a length along a periphery of said opening and a width transverse to the length, and wherein the length is longer than the width; and a plurality of blunt protrusions extending from the base surface, wherein each of said plurality of protrusions is hemi-spherical, wherein said protrusions provide sufficient friction to prevent or reduce sliding movement of said seat relative to a supporting surface comprising at least one of a fabric, leather or plastic, when said seat is placed on said supporting surface and a human is seated on said seat.

13. The seat of claim 12, wherein the base surface comprises a first portion opposite and spaced apart from a second portion, a third portion extending between the first and second portions, a fourth portion opposite the third portion and extending between the first and second portions, wherein the fourth portion is spaced apart from the third portion.

14. The seat of claim 13, wherein the plurality of protrusions extend only from the first and second portions.

15. The seat of claim 13, wherein a plurality of protrusions extends from each of the first, second, third and fourth portions.

16. The seat of claim 12, wherein the base surface is made from a first material and the protrusions are made from a second material different than the first material.

17. The seat of claim 12, wherein said hemi-spherical protrusions comprise a first row of hemi-spherical protrusions adjacent a second row of hemi-spherical protrusions, wherein the first row of hemi-spherical protrusions are staggered relative to the second row of hemi-spherical protrusions.

18. A seat and supporting surface combination comprising:

a supporting surface;

a seat resting on the supporting surface and comprising, a seating surface, a peripheral surface extending transversely from the seating surface, a base surface extending from the peripheral surface, said base surface bounding an opening, said base surface having a length along a periphery of said opening and a width transverse to the length, and wherein the length is longer than the width, and a plurality of blunt protrusions extending from the base surface and engaging the supporting surface, wherein each of said plurality of protrusions is hemi-spherical, wherein said protrusions provide sufficient friction to prevent or reduce sliding movement of said seat relative to a supporting surface comprising at least one of a fabric, leather or plastic, when a human is seated on said seat.

19. The combination of claim 18, wherein the supporting surface is a surface of a seat.

20. The combination of claim 18, wherein the base surface comprises a first portion opposite and spaced apart from a second portion, a third portion extending between the first and second portions, a fourth portion opposite the third portion and extending between the first and second portions, wherein the fourth portion is spaced apart from the third portion.

21. The seat of claim 20, wherein a plurality of protrusions extends from each of the first, second, third and fourth portions.

22. The combination of claim 18, wherein the plurality of protrusions extend only from the first and second portions, and wherein a plurality of said plurality of protrusions extend from the first portion and another plurality of said plurality of protrusions extend from the second portion.

23. The combination of claim 18, wherein each of said plurality of protrusions has a height extending from the base, wherein each protrusion has a diameter transverse to its height in the range of 2 to 10 mm.

24. The combination of claim 18, wherein the base surface is made from a first material and the protrusions are made from a second material different than the first material.

25. The combination of claim 18, wherein said hemi-spherical protrusions comprise a first row of hemi-spherical protrusions adjacent a second row of hemi-spherical protrusions, wherein the first row of hemi-spherical protrusions are staggered relative to the second row of hemi-spherical protrusions.

* * * * *